US007644832B1

(12) United States Patent
Tsengas et al.

(10) Patent No.: US 7,644,832 B1
(45) Date of Patent: Jan. 12, 2010

(54) RESEALABLE LID FOR OPEN CANS OF PET FOOD

(75) Inventors: Steven Tsengas, Fairport Harbor, OH (US); Jerry Sciarini, Fairport Harbor, OH (US)

(73) Assignee: OurPet's Co., Fairport Harbor, OH (US)

( * ) Notice: Subject to any disclaimer, the term of this patent is extended or adjusted under 35 U.S.C. 154(b) by 0 days.

(21) Appl. No.: 12/198,207

(22) Filed: Aug. 26, 2008

Related U.S. Application Data

(63) Continuation-in-part of application No. 11/260,772, filed on Oct. 28, 2005, now abandoned.

(51) Int. Cl.
*B65D 51/00* (2006.01)
*B65D 43/04* (2006.01)

(52) U.S. Cl. ..... 220/212; 220/287; 220/796; 220/805; 220/229

(58) Field of Classification Search ..... 215/228, 215/319; 220/805, 796, 254.1, 287, 212, 220/711, 697, 700; 222/575; D9/436; 30/124, 30/327, 326, 324
See application file for complete search history.

(56) References Cited

U.S. PATENT DOCUMENTS 1,779,018 A * 10/1930 Smallwood et al. ..... 206/15.3
2,175,735 A * 10/1939 Banks ..... 401/119
2,387,623 A 10/1945 Tillman
D167,088 S * 6/1952 Laughlin ..... 30/324
D200,447 S 2/1965 Lermer
4,415,097 A 11/1983 Meins
4,948,009 A 8/1990 Sawatani
5,695,084 A 12/1997 Chmela et al.
5,695,086 A * 12/1997 Viola ..... 220/287

* cited by examiner

*Primary Examiner*—Robin Hylton
(74) *Attorney, Agent, or Firm*—John D. Gugliotta, PE, Esq

(57) ABSTRACT

A removable serving lid is provided that sealingly covers the opening of a pet food can. A sealing sidewall extending downward form a flexible lid cover circumscribes the upper opening of a pet food can, and thereby forms an air-tight seal. The flexible material is designed to apply and remove easily, even when cold such as to accommodate refrigeration of any undispensed contents of a pet food can. A gripping flange extending laterally outward from the perimeter of the sidewall provides a gripping surface to facilitate removal of the sealed lid. Finally, an adjustable scoop is perpendicularly disposed through the flexible lid cover through a scoop aperture that seals against the handle of the scoop, maintaining a sealed environment even as the sloop is vertically adjusted into the contents of the food can.

10 Claims, 3 Drawing Sheets

RESEALABLE LID FOR OPEN CANS OF PET FOOD

RELATED APPLICATIONS

The present invention is a Continuation in Part of U.S. Ser. No. 11/260,772, now abandoned filed on Oct. 28, 2005 and incorporated by reference herein as if rewritten in its entirety.

BACKGROUND OF THE INVENTION

1. Field of the Invention

The present invention relates generally to canned pet food for dogs or cats and, more particularly, to a flexible, removable lid for sealingly closing an opened pet food can for storage and later use.

2. Description of the Related Art

As is well known in the art, both dog and cat food are currently distributed in canned form. There are commercially available three standardized sizes: a large can is 14 ounces; a smaller can is 6 ounces; and very small, 3 ounce capacity can. None of these are known to be resealable A search of the prior art did not disclose any patents that read directly on the claims of the instant invention; however, the following references were considered related.

U.S. Design No. D200,447, issued in the name of Lermer, teaches a cap having a generally planar suspension member bounded by a pair of oppositely disposed serpentine cures that lead to a generally circular recess. However, there is no opening having fluid communication through the cap.

U.S. Pat. No. 4,948,009, issued in the name of Sawatani discloses a straw, however, not a scoop for serving.

U.S. Pat. No. 5,695,084, issued in the name of Chmela et al., teaches a container closure and a utensil joined by a resilient hinge. However, Cmela again fails to teach an 'elongated slot' through the closure and fluid communication therethrough.

U.S. Pat. No. 2,387,623, issued in the name of Tillman, although not pertinent to the particular problem at issue herein, relates to a sanitary sugar bowl and extractor is to provide a bowl in which sugar contents are removed in a clean and sanitary manner.

U.S. Pat. No. 4,415,097 issued in the name of Meins, includes a press-in-tab, but again is not analogous to the present issue being solved.

Consequently, a need has been felt for providing an apparatus and method for sealing unused portions of canned pet food for later use.

SUMMARY OF THE INVENTION

It is therefore an object of the present invention to provide an improved food can lid.

It is a feature of the present invention to provide an improved flexible, removable lid for sealingly closing an opened pet food can for storage and later use.

Briefly described according to one embodiment of the present invention, a removable serving lid is provided that sealingly covers the opening of a pet food can. A sealing sidewall extending downward form a flexible lid cover circumscribes the upper opening of a pet food can, and thereby forms an air-tight seal. The flexible material is designed to apply and remove easily, even when cold such as to accommodate refrigeration of any un-dispensed contents of a pet food can. A gripping flange extending laterally outward from the perimeter of the sidewall provides a gripping surface to facilitate removal of the sealed lid. Finally, an adjustable scoop is perpendicularly disposed through the flexible lid cover through a scoop aperture that seals against the handle of the scoop, maintaining a sealed environment even as the sloop is vertically adjusted into the contents of the food can.

In accordance with a preferred embodiment, the present invention will allow a user to service multiple services from a pet food can while maintaining an air-tight seal between services.

Two preferred embodiment of the present invention are specifically adapted for either a 6 or 14 ounce pet food can, or a 3 ounce cat food can of the types currently widely commercially available.

An advantage of the present invention is that the service scoop can aid in the removal and dispensing of the pet food product from the pet food can.

Another advantage of the present invention is that provides an air-tight seal between servings to aid in maintaining product freshness.

Further, a preferred embodiment of the present invention is easy to apply and remove, stays flexible when cold, will not crack, is easy to clean, and can be made of readily available FDA listed materials.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
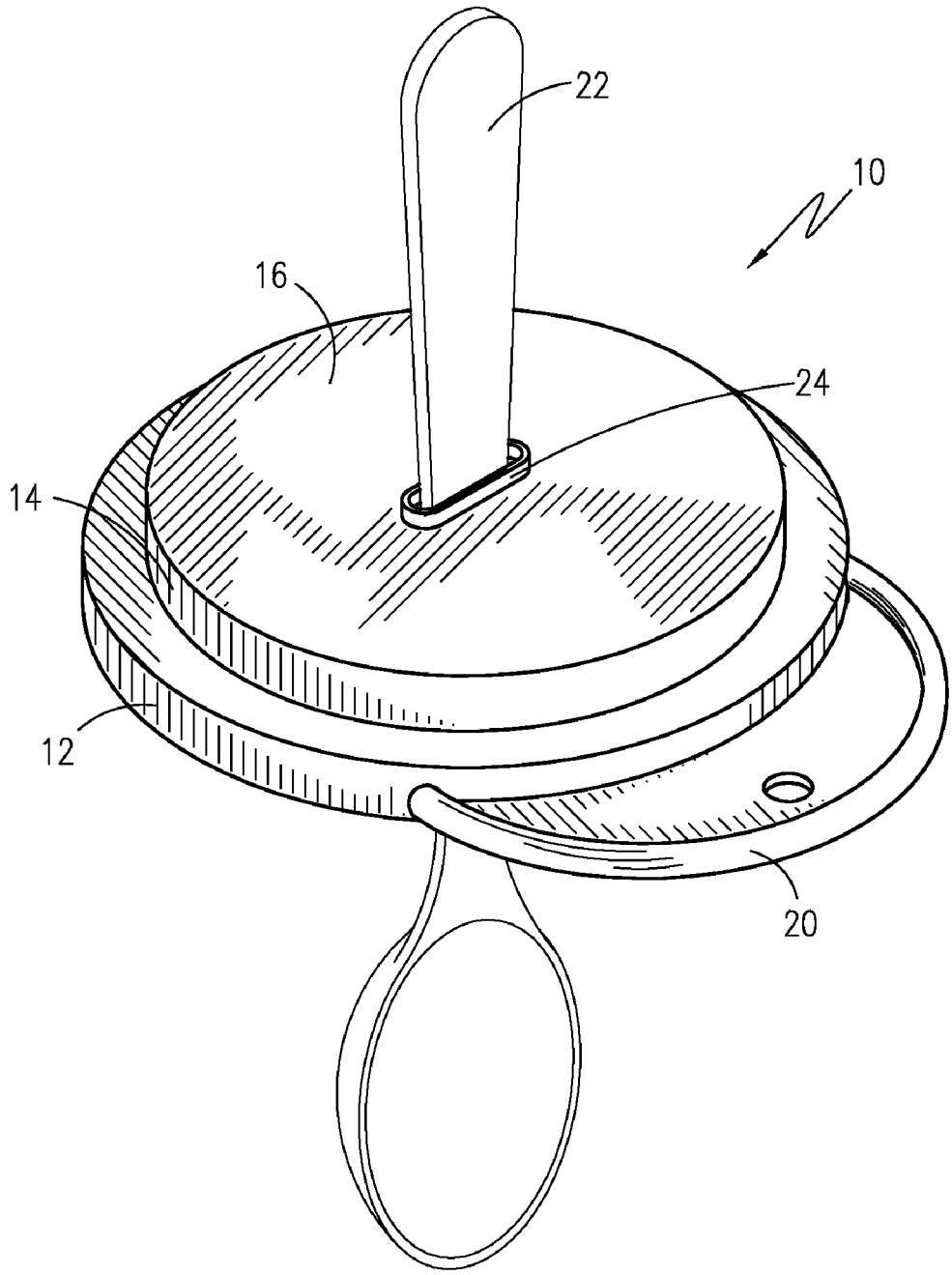
FIG. 1 is a upper perspective view of a removable serving lid according to the preferred embodiment of the present invention.
Figure 2:
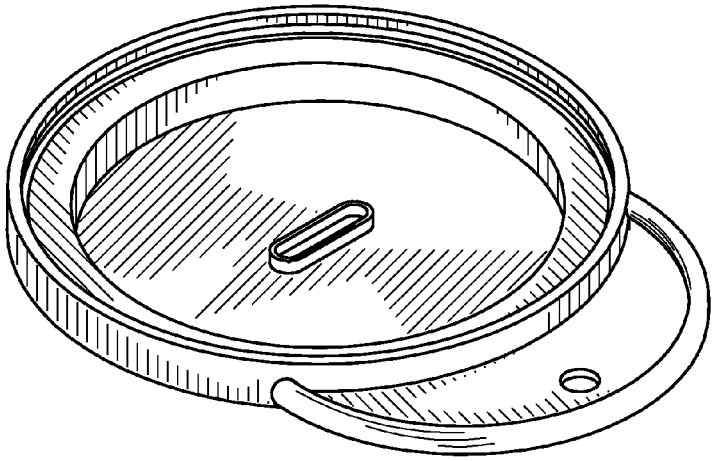
FIG. 2 is a lower perspective view thereof.
Figure 3:
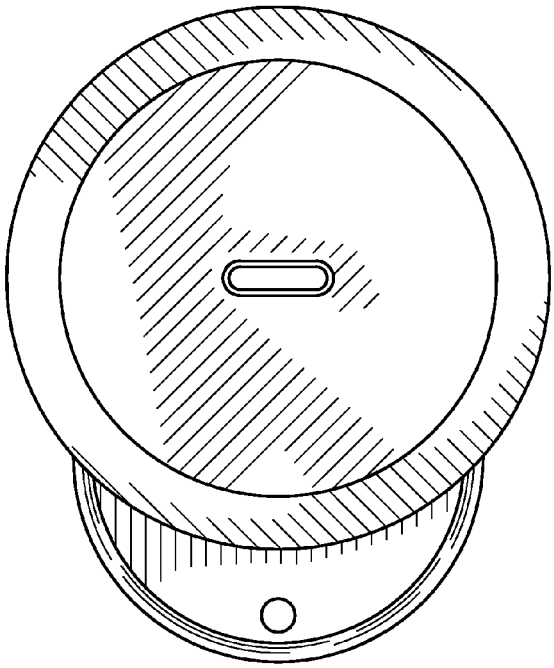
FIG. 3 is a top plan view thereof.
Figure 4:
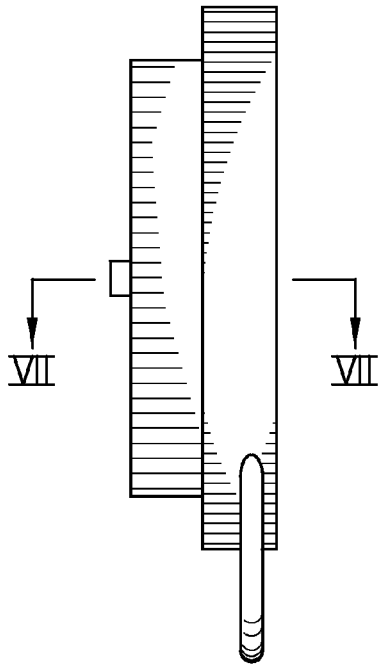
FIG. 4 is a side elevational view thereof.

In order to describe the complete relationship of the invention, it is essential that some description be given to the manner and practice of functional utility and description of currently commercially available canned pet food. Both dog and cat food are currently distributed in canned form. Specifically, dog food is usually distributed in one of two standard sizes of cans. A large can is 14 ounces, and a smaller can is 6 ounces. Both such cans are cylindrical in nature and have a standard and common upper diameter of 3.300 inches and 2.890 inches, respectively. Also, cat food is also distributed in a common smaller size, a 3 ounce capacity can that has an upper diameter of 2.410 inches.

The best mode for carrying out the invention is presented in terms of its preferred embodiment, herein depicted within the Figures.

1. Detailed Description of the Figures

Referring now to FIGS. 1-4, a removable serving lid 10 is shown, according to one embodiment of the present invention, is provided that sealingly covers the opening of a pet food can (not shown). As shown in this embodiment, a first sealing sidewall 12 extending downward from a second sealing sidewall 14, which in turn extends downward from a flexible lid cover 16. The first sealing sidewall 12 is sized and adapted to circumscribe the upper opening of an otherwise conventional 14 ounce pet food can, and thereby forms an air-tight seal. The second sealing sidewall 14 is sized and adapted to circumscribe the upper opening of an otherwise conventional 6 ounce pet food can, and thereby forms an air-tight seal. It is anticipated, as shown, that the second sidewall 14 essentially continues from the first sidewall 12, but it is slightly larger in circumference so that the pet food cover can accommodate different sized cans of pet food. The lid cover 16 is formed of a flexible material designed to apply and remove easily, even when cold such as to accommodate refrigeration of any un-dispensed contents of a pet food can. A gripping flange 20 extending laterally outward from the perimeter of the sidewall 12 and provides a gripping surface to facilitate removal of the sealed lid 10. Finally, an adjustable scoop 22 is perpendicularly disposed through the flexible lid cover 10 through a scoop aperture 24 that seals against the handle of the scoop 22, maintaining a sealed environment even as the scoop 24 is vertically adjusted into the contents of the food can.

Figure 5:
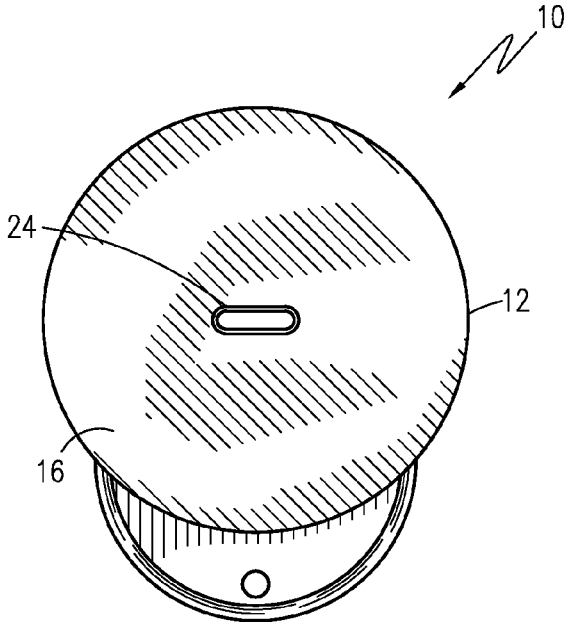
FIG. 5 and FIG. 6 are top plan and side elevational views, respectively, of a removable serving lid according to an alternate embodiment of the present invention adapted for use with a commercially available 3 ounce cat food can.
Figure 6:
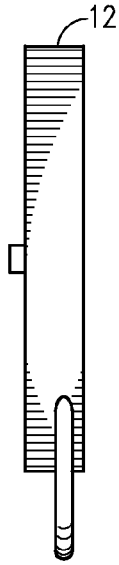

Referring to FIGS. 5-6, a of a removable serving lid 10 is shown according to an alternate embodiment of the present invention adapted for use with a commercially available 3 ounce cat food can. This removable serving lid 10 is shown, having only a first sealing sidewall 12 extending downward from a flexible lid cover 16. The first sealing sidewall 12 is sized and adapted to circumscribe the upper opening of an otherwise conventional 3 ounce cat food can, and thereby forms an air-tight seal. The lid cover 16 is formed of a flexible material designed to apply and remove easily, even when cold such as to accommodate refrigeration of any un-dispensed contents of a pet food can. A gripping flange 20 extending laterally outward from the perimeter of the sidewall 12 and provides a gripping surface to facilitate removal of the sealed lid 10. Finally, an adjustable scoop 22 is perpendicularly disposed through the flexible lid cover 10 through a scoop aperture 24 froming an elongated slot fromed through the lid cover 16 to receive, and seal against the handle of the scoop 22, maintaining a sealed environment even as the scoop 24 is vertically adjusted into the contents of the food can.

Figure 7:
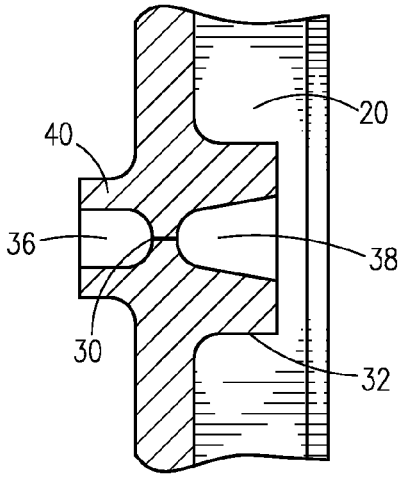
FIG. 7 is a detailed cross sectional view taken along line VII-VII of FIG. 4.

Finally, as shown in conjunction with FIG. 7 the details of the scoop aperture 24 are shown in greater detail for use with either embodiment. The scoop aperture 24 is formed as an elongated slot 30 circumscribed at its upper end by an upper aperture sidewall 32 and similarly about its lower end by a lower aperture sidewall 34. The upper aperture sidewall 32 forms an upper orifice 36, and the lower aperture sidewall 34 forms a lower orifice 38 such that the upper and lower orifices 36, 38 aligned and forms a sealing lip 40 that resiliently grips and seals around a shaft of a scoop 22 that is inserted there through.

2. Operation of the Preferred Embodiment

In operation, after a pet food can is opened the scoop 22 of the present invention is used to aid in dispensing food product from the can. Subsequently, the removable sealing lid 10 is attached to the opening of the pet food can in order to provide sealed, air-tight storage. The scoop 22 is slid up through the scoop aperture 24 to accommodate the level of can contents, but still maintains an air-tight seal around the handle of the scoop 24.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

Having thus described the invention what is claimed as new and desired to be secured by Letters Patent is as follows:

1. A lid for sealingly covering an open can of pet food, said lid comprising:

a first sealing sidewall;

a flexible lid cover having said first sealing sidewall extending downward therefrom; and an elongated slot formed through said lid cover, said elongated slot receives a scoop;

an upper aperture sidewall circumscribing the upper end of said elongated slot;

a lower aperture sidewall circumscribing the lower end of said elongated slot;

wherein said first sealing sidewall is sized and adapted to circumscribe an upper opening of a pet food can, and wherein said upper aperture sidewall forms an upper orifice and the lower aperture sidewall forms a lower orifice such that the upper and lower orifices align and forms a sealing lip that resiliently grips and seals around a shaft of a scoop that is inserted there through.

2. The lid of claim 1, further comprising a second sealing sidewall extending downward from a said first sealing sidewall, wherein said second sealing sidewall is continuous with said first sidewall, but it is slightly greater in circumference than said first sealing sidewall such that it is adapted to circumscribe an upper opening of a larger pet food can.

3. The lid of claim 1, wherein said lid cover is formed of a flexible material.

4. The lid of claim 2, wherein said lid cover is formed of a flexible material.

5. The lid of claim 1, further comprising a gripping flange extending laterally outward from the perimeter of the sidewall and provides a gripping surface to facilitate removal of the sealed lid.

6. The lid of claim 2, further comprising a gripping flange extending laterally outward from the perimeter of the sidewall and provides a gripping surface to facilitate removal of the sealed lid.

7. The lid of claim 1, further comprising:

an scoop perpendicularly disposed through said flexible lid cover through said scoop aperture that seals against a handle of the scoop, maintaining a sealed environment even as the scoop is vertically adjusted into the contents of the food can.

8. The lid of claim 2, further comprising:

an scoop perpendicularly disposed through said flexible lid cover through said scoop aperture that seals against a handle of the scoop, maintaining a sealed environment even as the scoop is vertically adjusted into the contents of the food can.

9. The lid of claim 1, wherein said first sealing sidewall comprises a circumference adapted to circumscribe the upper opening of an otherwise conventional 3 ounce pet food can.

10. A lid for sealingly covering an open can of pet food, said lid comprising:

a first sealing sidewall;

a flexible lid cover having said first sealing sidewall extending, downward therefrom;

a second sealing sidewall extending downward at a terminal end of said first sealing sidewall, said second sealing sidewall comprises a circumference greater than said first sealing sidewall so that said lid can be used to cover different sizes of cans of pet food; and an elongated slot formed through said lid cover, said elongated slot receives a scoop;

an upper aperture sidewall circumscribing the upper end of said elongated slot;

a lower aperture sidewall circumscribing the lower end of said elongated slot;

wherein said first and said second sealing sidewalls are sized and adapted to circumscribe an upper opening of a pet food can, and wherein said upper aperture sidewall forms an upper orifice and the lower aperture sidewall forms a lower orifice such that the upper and lower orifices align and forms a sealing lip that resiliently grips and seals around a shaft of a scoop that is inserted there through.

* * * * *